United States Patent [19]

Harada et al.

[11] Patent Number: 4,914,353

[45] Date of Patent: Apr. 3, 1990

[54] THIN-FILM EL DISPLAY PANEL DRIVE CIRCUIT

[75] Inventors: Shigeyuki Harada; Toshihiro Ohba; Yoshiharu Kanatani, all of Nara; Hisashi Uede, Wakayama, all of Japan

[73] Assignee: Sharp Kabushiki Kaisha, Osaka, Japan

[21] Appl. No.: 217,076

[22] Filed: Jul. 8, 1988

Related U.S. Application Data

[63] Continuation of Ser. No. 737,220, May 23, 1985, abandoned.

[30] Foreign Application Priority Data

May 23, 1984 [JP] Japan ..... 59-105377

[51] Int. Cl.[4] ..... G09G 3/10

[52] U.S. Cl. ..... 315/169.3; 340/781; 340/825.81

[58] Field of Search ..... 315/169.2, 169.3, 107; 340/781, 825.81

[56] References Cited

U.S. PATENT DOCUMENTS

| | | | |
|---|---|---|---|
| 3,885,196 | 5/1975 | Fischer | 340/781 |
| 4,032,818 | 6/1977 | Chan | 315/169.2 |
| 4,338,598 | 7/1982 | Ohba et al. | 340/825.81 |
| 4,485,379 | 11/1984 | Kinoshita et al. | 340/825.81 |

*Primary Examiner*—Benedict V. Safourek
*Assistant Examiner*—T. Salindong
*Attorney, Agent, or Firm*—Birch, Stewart, Kolasch & Birch

[57] ABSTRACT

The preferred embodiment discloses a new thin-film EL display panel drive circuit using EL layers installed between the scan-side electrodes and the data-side electrodes aligned so as to allow them to cross one another, comprising: scan-side electrodes connected to the drain terminal of the N-ch high-voltage resistant driver having a grounded source terminal and also connected to the other drain terminal of the P-ch high-voltage resistant driver having a source terminal connected to the pull-up charge drive circuit and to the write drive circuit via the scan-side common bus line; and data-side electrodes connected to the drain terminal of the N-ch high-voltage resistant driver having a grounded source terminal and also having the anode common terminal connected to the cathode terminal of the diode array connected to the preliminary charge drive circuit via the data-side common bus line. By grounding the source terminal to the scan-side N-ch MOS ICs, some of the floating-output logic-circuit driving power sources and some of the logic signal transmission photo-couplers can be eliminated. This not only saves component elements conventionally needed for the P-N symmetric EL display panel drive circuits, but also securely suppresses noise interference, thus offering an indispensable technique giving an early and overall improvement over those thin-film EL display drive circuits thus far made available.

4 Claims, 11 Drawing Sheets

THIN-FILM EL DISPLAY PANEL DRIVE CIRCUIT

This application is a continuation of application Ser. No. 737,220 filed on May 23, 1985, now abandoned.

BACKGROUND OF THE INVENTION

The present invention relates to the drive circuit for a thin-film EL display panel and more particularly, to a drive circuit which is substantially of the AC-driven capacitor-type for a flat matrix display panel driven by voltages.

Both the double-insulation or triple-insulation type of thin-film EL display panel are typically constructed as follows. As shown in FIG. 2, a plurality of belt-shaped transparent electrodes 2 composed of $In_2O_3$ are formed onto a glass substrate 1 parallel to each other. Then, conductive layers 3 composed of, for example, $Y_2O_3$, $Si_3N_4$, $TiO_2$ or $Al_2O_3$ an EL layer 4 composed of ZnS containing a doped activating agent such as Mn, and an identical conductive layer 3' composed of either $Y_2O_3$, $Si_3N_4$, $TiO_2$ or $Al_2O_3$ are laid sequentially employing any thin-film adhesion technology such as vapor-phase adhesion or the sputtering process to form a triple-layered structure having a thickness of from 500 to a maximum of 10,000 angstroms. Then, belt-shaped rear surface electrodes 5 composed of $Al_2O_3$ are installed parallel to each other so that they cross the transparent electrodes 2 at right angles. Since the thin-film EL display panel is provided with an EL layer 4 sandwiched between electrodes by the conductive layers 3 and 3', such a thin-film EL display panel can be considered as a capacitive element from the viewpoint of an equivalent circuit. As is clear from the graphic chart denoting the relationship between voltages and the luminance characteristics shown by the solid line in FIG. 3, such a thin-film EL display panel is normally driven by means of a relatively high voltage reaching about 200 VAC, for example.

BACKGROUND ART

Japanese Patent Application No. 59/66166 entitled "DRIVE SYSTEM FOR THIN-FILM EL DISPLAY PANEL" and the corresponding patent applications filed in the United States of America, the Federal Republic of Germany and the United Kingdom, using the same title of invention under our reference number 2514, present a new drive circuit configuration for AC-driven capacitor-type thin-film EL display panels featuring the capability of applying optimum pulses to the display panel itself by combining the drive circuit of the scan electrodes with the N-ch high-voltage resistant MOS driver for performing a pull-down function and the P-ch high-voltage resistant MOS driver for performing a pull-up function.

FIGS. 4 and 5 respectively show configurations of the above mentioned drive circuits. In FIG. 4, reference number 10 indicates the thin-film EL display panel, in which the scan-side electrodes are formed in the X direction and the data-side electrodes are formed in the Y direction. Reference numbers 20 and 30 respectively indicate the scan-side N-ch high-voltage resistant MOS ICs dealing with the odd and even lines of those electrodes formed in the X-direction. Reference numbers 21 and 31 respectively indicate logic circuits typically comprised of shift-registers set inside respective ICs. Reference numbers 40 and 50 respectively indicate scan-side P-ch high-voltage resistant MOS ICs. Reference numbers 41 and 51 respectively indicate logic circuits typically comprised of shift-registers set inside respective ICs. Reference number 60 indicates a data-side N-ch high-voltage resistant MOS IC, while reference number 61 indicates a logic circuit comprised of a shift-register set inside the MOS IC. Reference number 70 indicates a data-side diode array that separates data-side drive lines and protects switching elements from bias inversion. Reference number 80 indicates a preliminary charge drive circuit. Reference number 90 indicates a pull-up charge drive circuit. Reference number 100 indicates a write driving circuit. Reference number 110 indicates a source potential switching circuit available for the scan-side N-ch high-voltage resistant MOS ICs 20 and 30, while these are normally held at the ground potential. In FIG. 5, reference number 120 indicates a power source for driving the scan-side N-ch ICs. Reference number 130 indicates a signal transmission photo-coupler available for the scan-side N-ch ICs. Reference number 140 indicates a power source for driving the P-ch ICs. Reference number 150 indicates a signal transmission photo-coupler available for the scan-side P-ch ICs. Reference number 160 indicates a power source for driving the data-side N-ch ICs. Reference number 170 indicates a timing control circuit board. FIG. 6 shows the ON-OFF timing chart of respective high-voltage resistant MOS ICs, the circuits driving these ICs, and the source potential switching circuit. FIG. 7 shows such voltage waveforms typically applied to picture elements A and B shown in FIG. 4. Referring now to FIGS. 6 and 7, the operations of a conventional thin-film EL display panel as shown in FIG. 4 are described below. Assume that the driving is sequentially applied to the lines, while the scan-side electrode X2 containing the picture element A is selected. As described later on, driving is performed by inverting the polarity of a specific voltage applied to the picture elements in each field. In the following description, the first field is called "N-ch field" and the second field "P-ch field", respectively.

N-ch field

The first stage T1: Preliminary charge period

First, all the MOS transistors NT1 through NTi inside the scan-side N-ch high-voltage resistant MOS ICs 20 and 30 are respectively activated by setting the source potential switching circuit 110 to the ground potential. Simultaneously, the entire surface of the display panel is charged through the data-side diode array 70 by activating the preliminary charge drive circuit 80 using $\frac{1}{2}VM=30$ VAC of voltage. During this period, MOS transistors Nt1 through Ntj inside the data-side N-ch high-voltage resistant MOS IC 60 and MOS transistors PT1 through PTi inside the scan-side P-ch high-voltage resistant MOS ICs 40 and 50 are all turned OFF.

The second stage T2: Discharge/pull-up charge period

Next, MOS transistors NT1 through NTi inside the scan-side N-ch high-voltage resistant MOS ICs 20 and 30 are all turned OFF, and, in addition, only MOS transistor Nt2 connected to the selected data-side driver electrode (Y2, for example) inside the data-side N-ch high-voltage resistant MOS IC 60 is turned OFF. All the MOS transistors Nt1 through Ntj connected to other data-side drive electrodes are turned ON. Simultaneously, MOS transistors PT1 through PTi inside the scan-side P-ch high voltage resistant MOS ICs 40 and 50 are activated. By forming a ground loop through a combination of MOS transistors Nt1 through Ntj (except for Nt2) inside the activated data-side N-ch high-voltage resistant MOS IC 60, all the MOS transistors PT1 through PTi inside the scan-side P-ch high-voltage resistant MOS IC4 40 and 50, and diode 101 inside the write-driving circuit 100, the charge stored in the data-side non-selected electrode (Yi≠2) is then discharged. Next, by activating the pull-up charge drive circuit 90 using ½ VM=30 VAC of voltage, the potentials of all the scan-side electrodes are raised to 30 V. During this period, all the MOS transistors NT1 through NTi inside the scan-side N-ch high-voltage resistant MOS ICs 20 and 30 are turned OFF. Thus with reference to the scan-side electrode (X), the selected data-side electrode (Y2) remains at +30 V, whereas the data-side non-selected electrode (Yj≠2) is lowered to −30 VAC.

The third stage T3: Write driving period

Since the scan-side electrode selected by the line-sequential drive is X2, only the MOS transistor NT2 connected to X2 of the scan-side N-ch high-voltage resistant MOS IC 30 is activated, whereas all the MOS transistors PT2 through PTi inside the even-line side P-ch high-voltage resistant MOS IC 50 are turned OFF. During this period, all the MOS transistors PT1 through PTi-1 inside the odd-line side P-ch high-voltage resistant MOS IC 40 remain activated. Simultaneously, by activating the write-driving circuit 100 using VW=190 V of voltage, the potentials of all the odd-number scan-side electrodes are raised to 190 V via all the MOS transistors PT1 through PTi-1 inside the odd-line side P-ch high-voltage resistant MOS IC 40. As a result, due to the characteristics of the coupled capacitance, the voltage of the selected data-side driver electrode is raised to VW+½ VM=220 V, and, as a result, the voltage of the non-selected data-side electrode is also raised to VW−½ VM=160 V. If the selected scan-side electrode (X) is on the odd line, the voltages of all the even-side scan electrodes are raised to 190 V by activating all the MOS transistors PT2 through PTi inside the even-line scan P-ch high-voltage resistant MOS IC 50. Then, by sequentially driving the scan-side electrodes X1 through Xi as was done during the first through third stages for the scan-side electrode X2, the driving of the N-ch field is completed. The driving of the P-ch field is then started during the following stage.

P-ch field

The first stage T1': Preliminary charge period

All processes during the preliminary charge period are executed in exactly the same manner as was done for the N-ch field during the first stage.

The second stage T2': Discharge/pull-up charge period First, all the MOS transistors NT1 through NTi inside the scan-side N-ch high-voltage resistant MOS ICs 20 and 30 are turned OFF. In contrast to the N-ch field, only the MOS transistor (Nt2, for example,) connected to the selected data-side drive circuit remains activated inside the data-side N-ch high-voltage resistant MOS IC 60, whereas other MOS transistors Nt1 through Ntj (except for Nt2) connected to the data-side drive electrode are all turned OFF. Simultaneously, all the MOS transistors PT1 through PTi inside the scan-side P-ch high-voltage resistant MOS ICs 40 and 50 are activated. The charge stored in the selected electrodes on the data-side is discharged by the ground loop formed by MOS transistor Nt2 inside the activated data-side N-ch high-voltage resistant MOS IC60, by MOS transistors PT1 through PTi inside the scan-side P-ch high-voltage resistant MOS ICs 40 and 50, and by diode 101 inside the write-driving circuit 100. Then, by activating the pull-up charge drive circuit 90, the potentials of all the scan-side electrodes (X) are raised to ½ VM=30 V of the voltage. During this period, all the MOS transistors NT1 through NTi inside the scan-side N-ch high-voltage resistant MOS ICs 20 and 30 are turned OFF. As is clear from a consideration of what happens when centering the scan-side electrode (X), the selected data-side electrode (Y2) remains at −30 V, whereas the data-side non-selected electrode (Yj≠3) remains at +30 V, respectively.

The third stage T3': Write driving period

If the selected scan-side electrode is X2, only MOS transistor PT2 connected to X2 inside the scan-side P-ch high-voltage resistant MOS IC50 remains activated, whereas other MOS transistors are all turned OFF. Also, all the MOS transistors NT2 through NTi inside the even-line scan-side N-ch high-voltage resistant MOS IC 30 are turned OFF, whereas all the MOS transistors NT1 through NTi-1 inside the opposite odd-line scan-side N-ch high-voltage resistant MOS IC 20 remain activated. Then, the write-driving circuit 100 (the sum of the voltage VW=190 V and ½ VM=30 V) is activated so that 220 V of voltage can be supplied to the scan-side electrode X2 via the activated MOS transistor PT2. At the same time, the voltage of the source potential switching circuit 110 is switched to ½ VM=30 V, and then, by referring to 30 V of the source potential inside the odd-line N-ch high-voltage resistant MOS IC 20, the potential of the odd-line scan electrode is lowered to +30 V. As a result, due to the characteristics of the coupled capacitance, the potential of the selected data-side drive electrode Y2 is lowered to −220, and that of the non-selected data electrode (Yj≠2) is lowered to −160 VAC. If the selected scan-side electrode is on the odd line, all the MOS transistors NT2 through NTi inside the scan-side N-ch high-voltage resistant MOS IC 30 opposite from a MOS transistor connected to the selected scan electrode of the scan-side P-ch high-voltage resistant MOS IC 40 are activated. P-ch field driving is now completed by sequentially driving the scan-side electrodes X1 to Xi through the first to third stages.

As is clear from the time chart shown in FIG. 7, the write voltage VW+½ VM=220 V has has inverse polarity in the N-ch and P-ch fields and enough power for illumination is supplied to the picture elements located at the selected crossing points. In other words, the AC cycles needed for driving the thin-film EL display panel are closed by two fields including the N-ch and P-ch fields. Although VW−½ VM=160 V of the voltage is supplied to the non-selected picture elements, such a voltage is below the threshold value needed for effective illumination. The same relationship in conjunction with the timing of supplying the positive and negative writing pulses can be applied to any of the scan-side electrodes. Any DC voltage generated by the preliminary charge voltage is effectively cancelled by both the N-ch and P-ch fields.

Nevertheless, when using such a circuit construction thus described and shown in FIG. 4, since the source potentials of the logic circuits of the scan-side N-ch MOS ICs and P-ch MOS ICs are respectively different from those of the logic circuits on the data-side N-ch MOS ICs, such circuit construction still needs to provide the power sources 120 and 140, shown in FIG. 5, for the supply of floating outputs to a pair of logic circuits of the scan-side ICs and also needs to provide photo-couplers 130 and 150 for transmitting logic signals. In addition, such conventional circuit construction may cause the scan-side logic circuits to malfunction at any time due to noise interference.

OBJECT OF THE INVENTION

In the light of such disadvantages still present in any of the background thin-film EL display panel drive circuits thus described, the present invention aims at providing a unique system capable of securely eliminating part of the power sources available for the floating output logic circuits and also part of the photo-couplers transmitting logic signals, securely preventing the logic circuits from unwanted malfunction due to noise interference, and enhancing the noise suppression margin so that the total reliability of the driver unit can be significantly improved.

DETAILED DESCRIPTION OF THE PREFERRED EMBODIMENT

Figure 1:
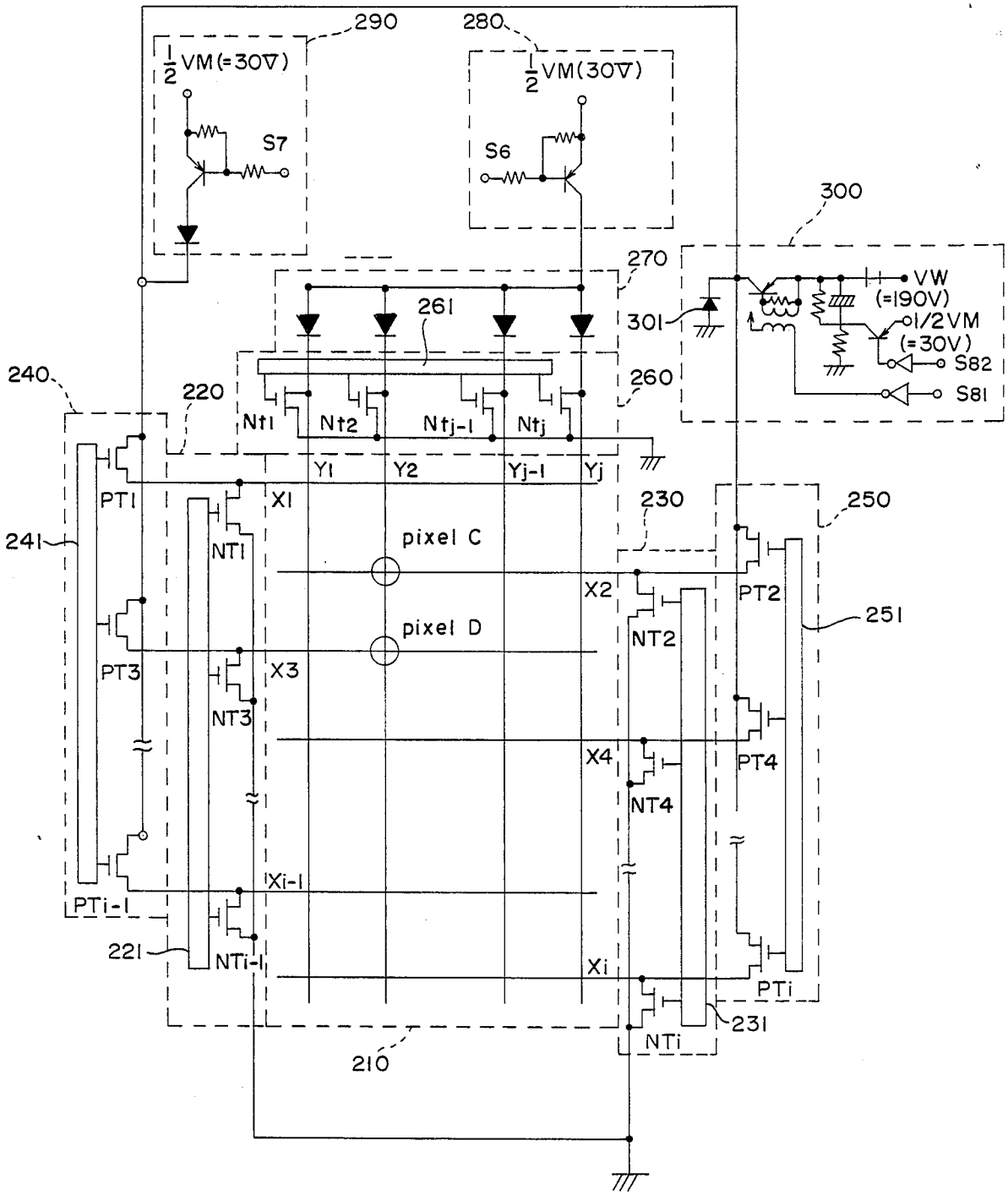
FIGS. 1 and 8 are respectively block diagrams showing the drive circuit construction incorporating the preferred embodiments of the present invention.
Figure 2:
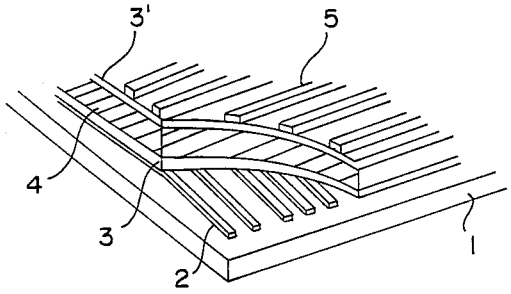
FIG. 2 is a perspective view of a partially cut-out portion of the thin-film EL display panel.
Figure 3:
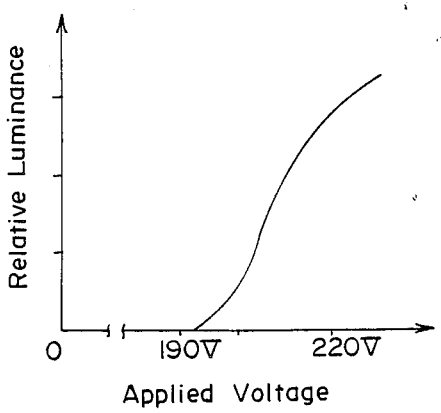
FIG. 3 is a chart showing the relationship between the supplied voltages and the luminance characteristics.
Figure 5:
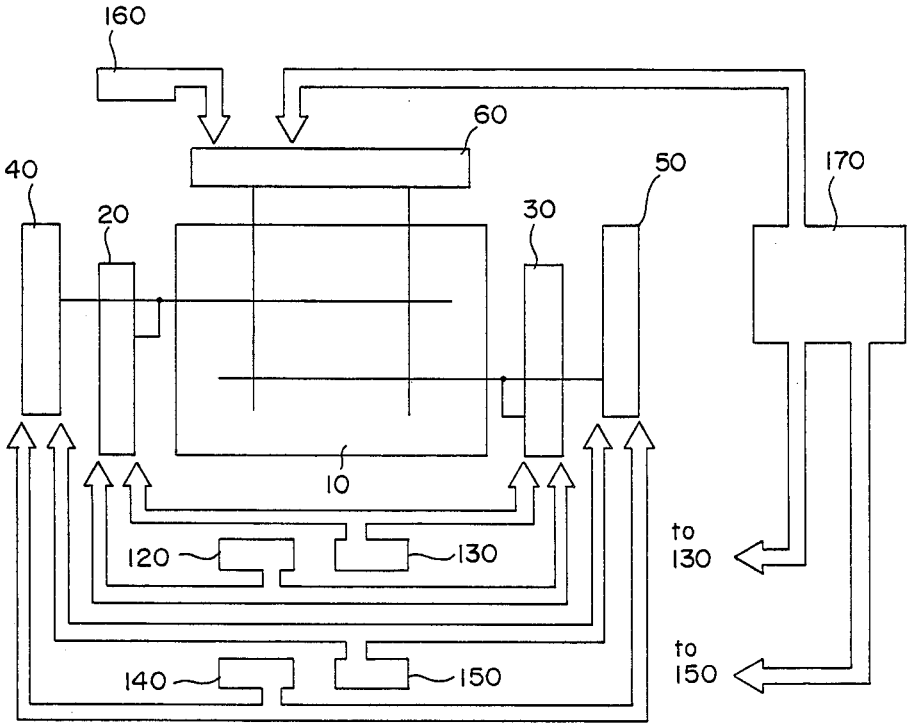
FIGS. 4 and 5 are block diagrams of background drive circuit constructions.
Figure 4:
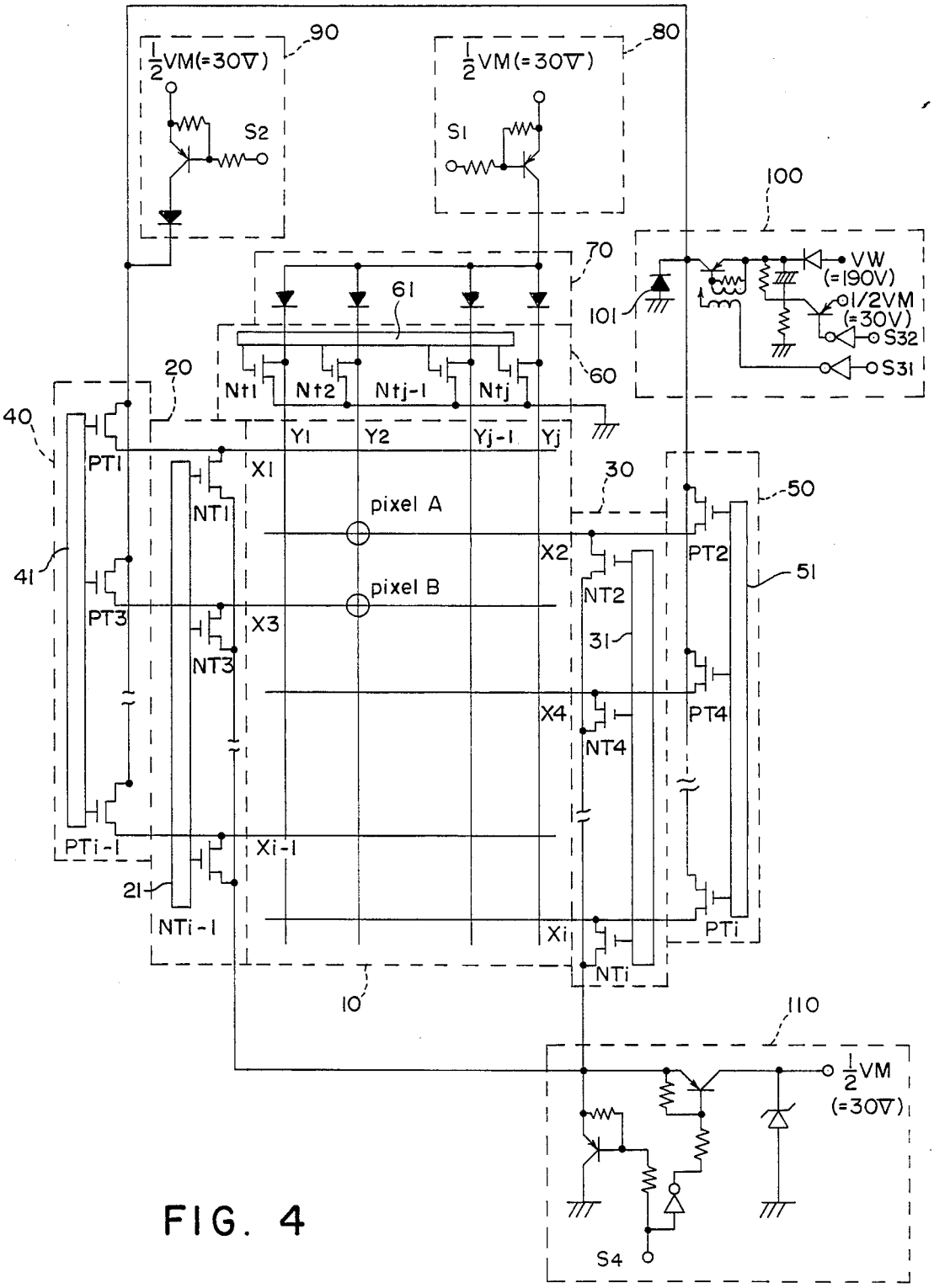
Figure 6:
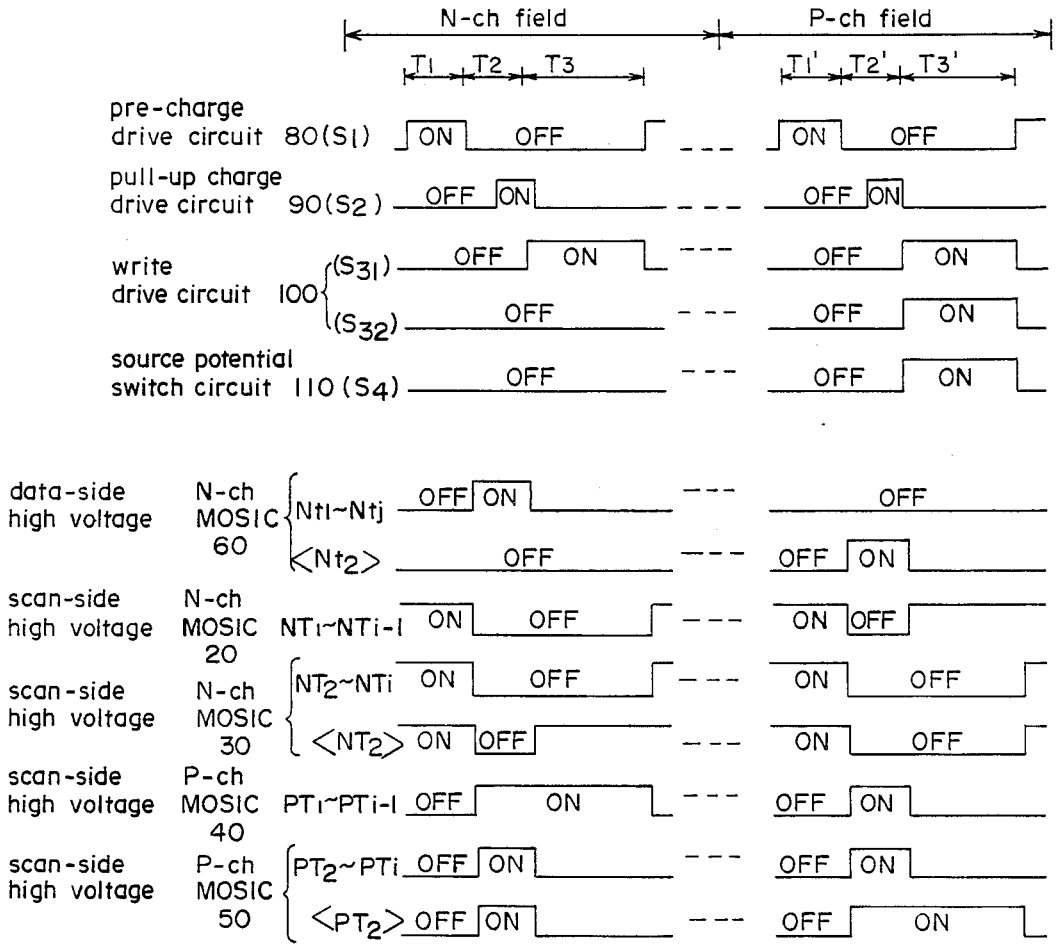
FIG. 6 is an ON-OFF timing chart of operations performed by respective components of the drive circuit.
Figure 7:
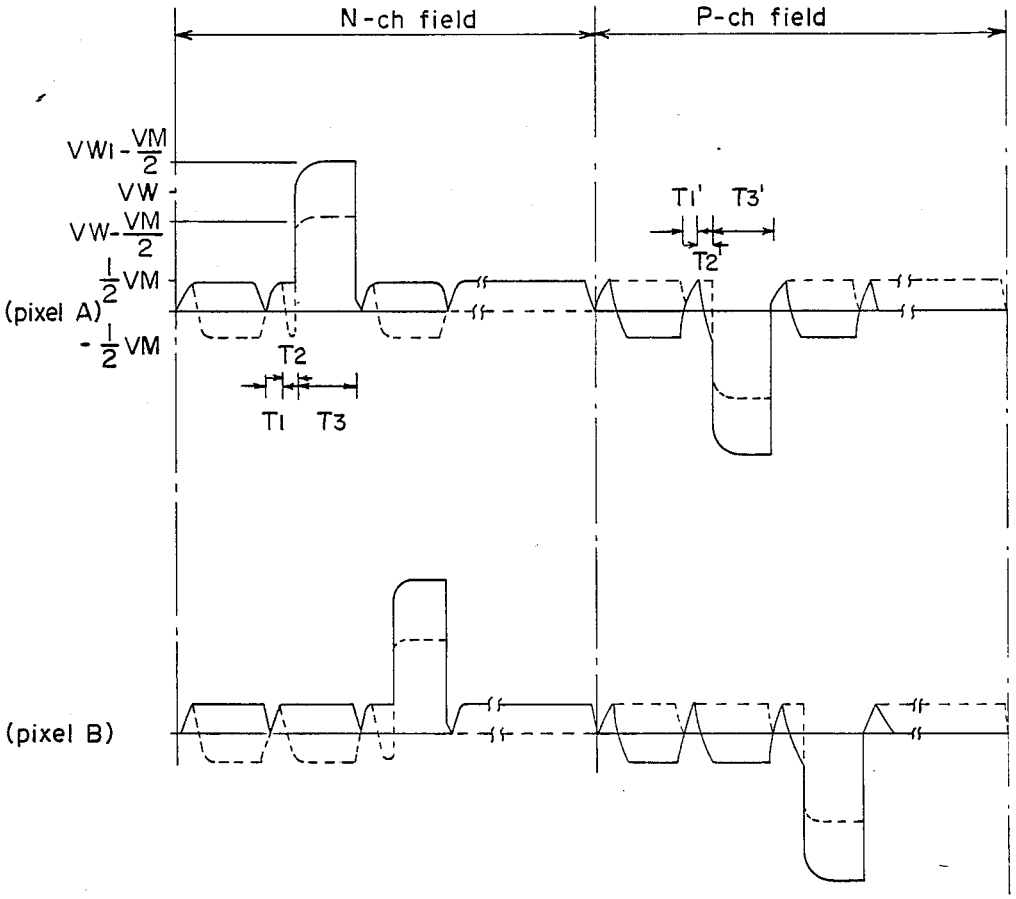
FIG. 7 is a timing chart showing waveforms of voltages supplied to picture elements A and B shown in FIG. 4.
Figure 8:
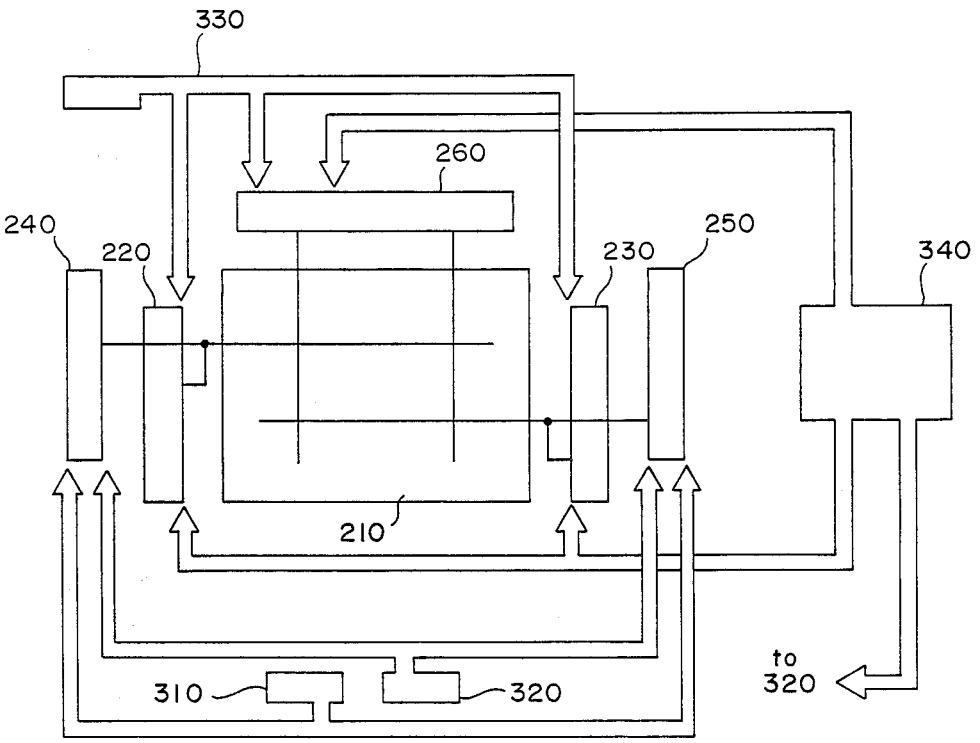
Figure 9A:
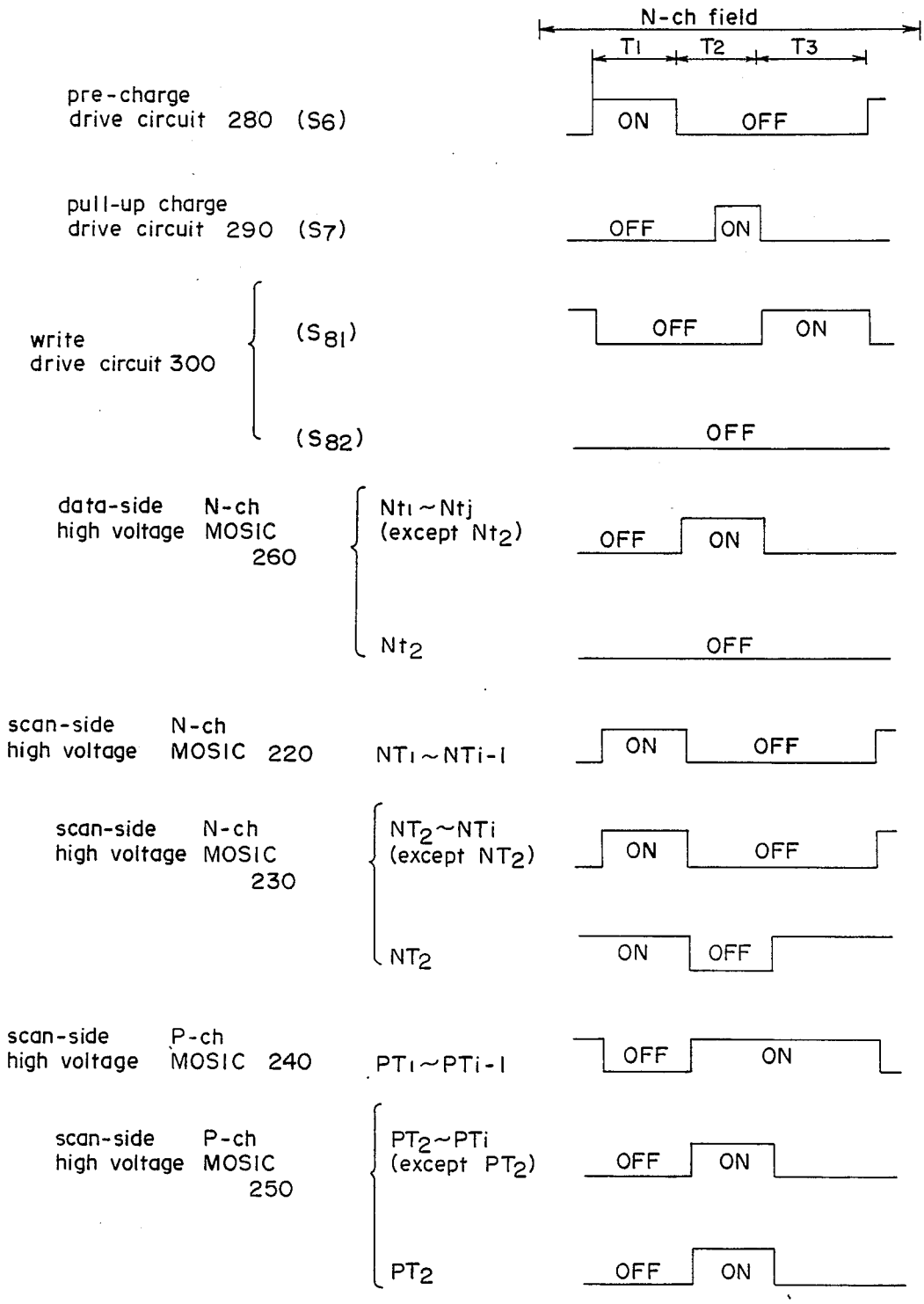
FIGS. 9(*a–b*) is an ON-OFF timing chart of operations performed by the respective components shown in FIG. 1.
Figure 9B:
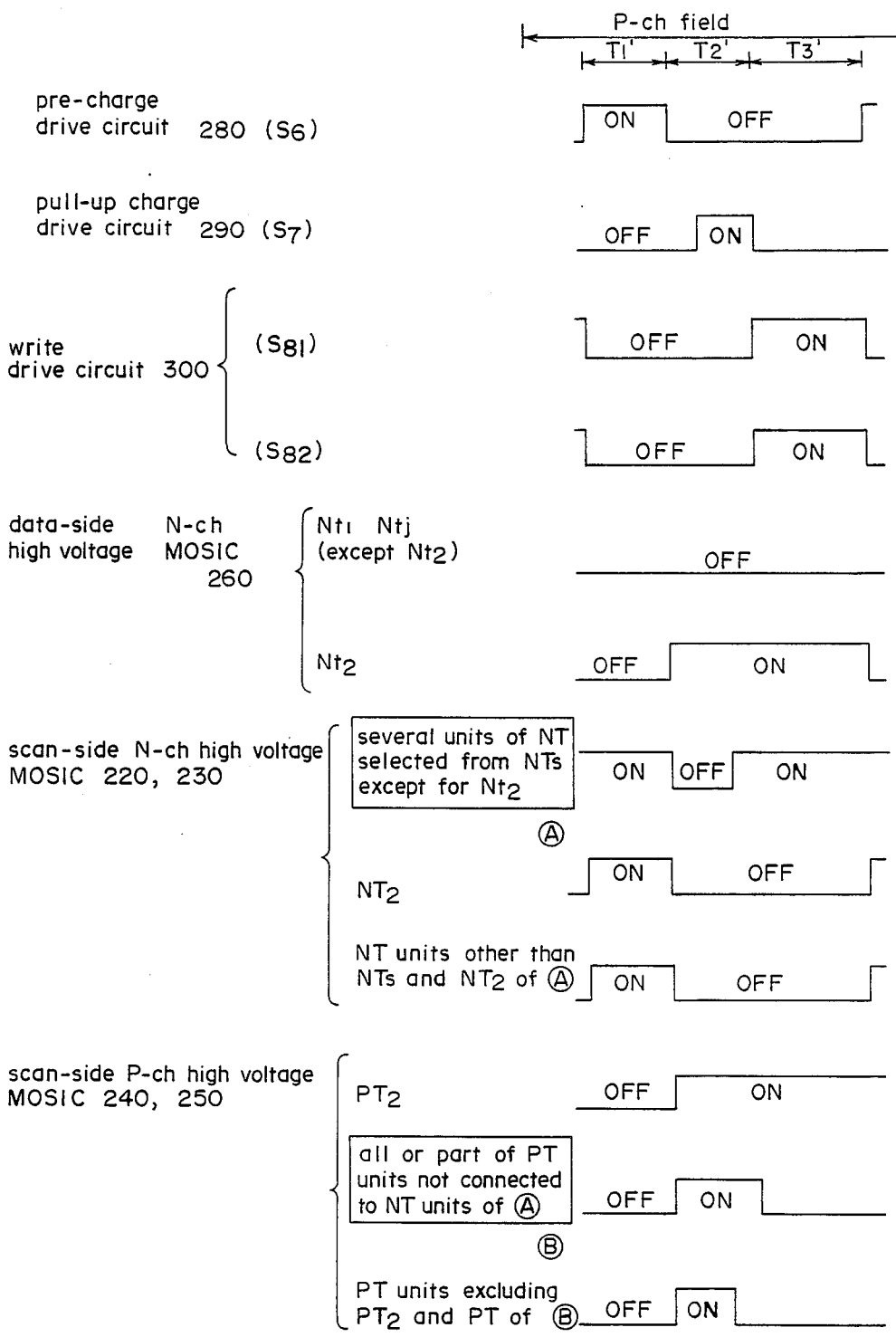
Figure 10:
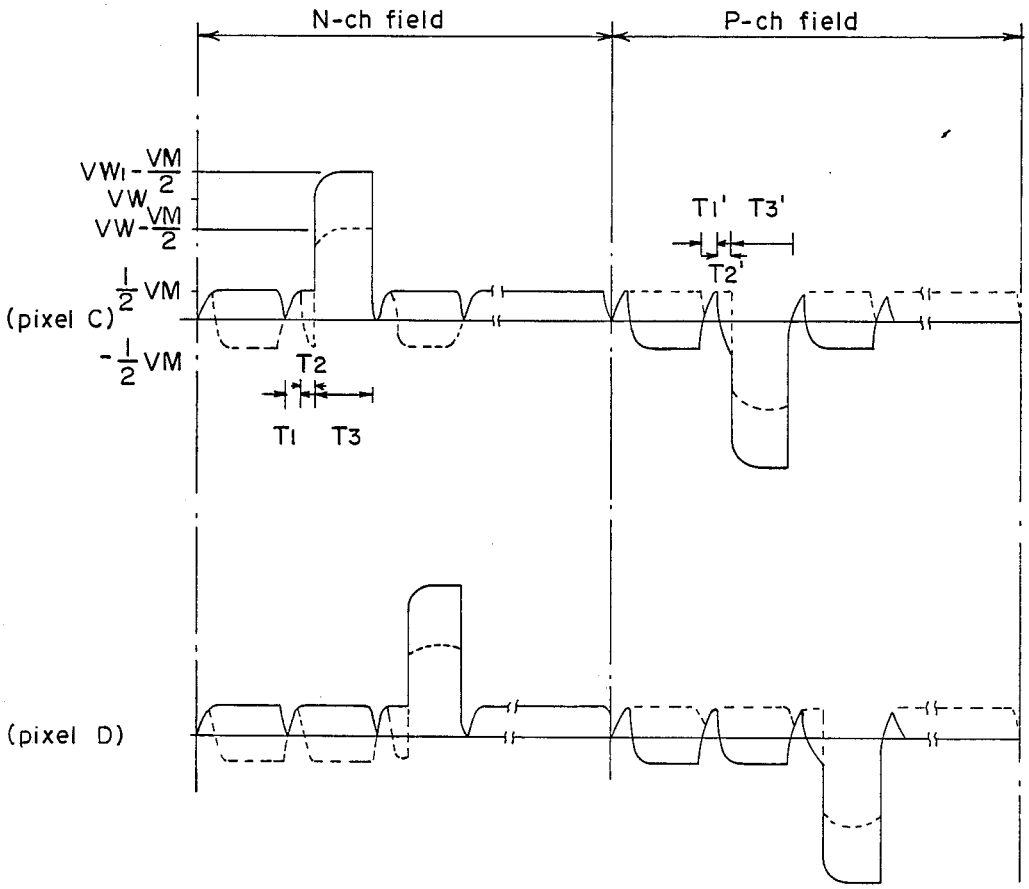
FIG. 10 is a timing chart showing the waveforms of voltages supplied to the picture elements C and D shown in FIG. 1.

Referring now to FIGS. 1 and 8, the configuration of the new thin-film EL display panel drive circuit incorporating the preferred embodiment of the present invention is described below. In FIG. 1, reference number 210 indicates the thin-film EL display panel, where the X-direction electrodes are designated as the scan-side electrodes, and the Y-direction electrodes are designated as the data-side electrodes, and thus, only electrodes are shown in this portion of the drawing. Reference numbers 220 and 230 respectively indicate the scan-side N-ch high-voltage resistant MOS ICs corresponding to the respective even lines and odd lines in the X direction. Reference numbers 221 and 231 respectively indicate logic circuits comprised of shift-registers stored in respective ICs. Reference number 240 and 250 respectively indicate the scan-side P-ch high-voltage resistant MOS ICs. Reference numbers 241 and 251 respectively indicate the logic circuits comprised of shift-registers stored in respective MOS ICs. Reference number 260 indicates the data-side N-ch high-voltage resistant MOS IC, while reference number 261 indicates the logic circuit comprised of a shift-register held in an IC. Reference number 270 indicates the data-side diode array which separates the data-side drive line and protects switching elements from bias inversion. Reference number 280 indicates the preliminary charge drive circuit. Reference number 290 indicates the pull-up charge drive circuit. Reference number 300 indicates the write driving circuit. In FIG. 8, reference number 310 indicates the power source for driving the scan-side P-ch IC. Reference number 320 indicates the signal transmission photo-coupler available for the scan-side P-ch MOS ICs. Reference number 330 indicates a power source for driving both the data-and scan-side N-ch MOS ICs. Reference number 340 indicates the timing control circuit board. FIG. 9 shows the ON-OFF timing related to the operations of respective circuits and component elements. FIG. 10 shows the waveforms of such voltages typically supplied to picture elements C and D shown in FIG. 1. Referring now to the case where scan-side electrode X2 containing picture element C is used for selected scan-side electrodes, operations of the drive circuit are described below. The drive circuit embodied by the present invention executes its driving operation by inverting the polarity of a specific voltage applied to the picture elements in each field. The first field is called N-ch field and the second field the P-ch field.

The first stage T1 of the N-ch field: Preliminary charge period

During the first stage T1, first, all the MOS transistors NT1 through NTi inside the scan-side N-ch MOS ICs 220 and 230 are activated. Simultaneously, the preliminary charge drive circuit using $\frac{1}{2}$ VM=30 V of voltage is also activated to charge the entire surface of the display panel via the data-side diode array 270. During this period, MOS transistors Nt1 through Ntj inside the data-side N-ch MOS IC 260 and MOS transistors PT1 through PTi inside the scan-side P-ch MOS ICs 240 and 250 all remain OFF.

The second stage T2 of N-ch field: Discharge/pull-up charge period

Next, all the MOS transistors NT1 through NTi inside the scan-side N-ch MOS ICs 220 and 230 are turned OFF. In addition, while causing only those MOS transistors connected to the selected data-side electrodes of the data-side N-ch MOS IC260 to remain OFF, other MOS transistors connected to the data-side driver electrode are activated. Simultaneously, all the MOS transistors PT1 through PTi inside the scan-side P-ch MOS ICs 240 and 250 are also activated. Charge stored in the non-selected electrodes of the data-side is discharged by the ground loop formed by the combination of MOS transistors inside the activated data-side N-ch MOS IC260, all the MOS transistors PT1 through PTi inside the scan-side P-ch MS ICs 240 and 250, and diode 301 inside the write driving circuit 300. Next, potentials of all the scan-side electrodes are raised to $\frac{1}{2}$ VM (30 V) by activating all the MOS transistors inside the scan-side P-ch MOS ICs and the pull-up charge drive circuit 290. During this period, all the MOS transistors of the scan-side N-ch MOS ICs remain OFF. As is clear from a consideration of what happens when centering the scan-side electrodes, the selected data-side electrode remains at +30 V and the non-selected electrodes at −30 V, respectively.

The third stage T3 of N-ch field: Write drive period

If the selected scan-side electrode is X2, only MOS transistor NT2 connected to X2 inside the scan-side N-ch MOS IC 230 is activated, whereas all the MOS transistors PT2 through PTi inside the even-side P-ch MOS IC 250 are turned OFF. During this period, all the MOS transistors PT1 through PTi-1 inside the opposite odd-side P-ch MOS IC 240 are activated. Simultaneously, the write driving circuit 300 is also activated so that the potentials of all the odd-number scan electrodes are raised to VW (190 V) of the voltage via all the MOS transistors PT1 through PTi-1 inside the odd-side P-ch MOS IC 240. As a result, due to the characteristics of the coupled capacitance, the potential of the selected data-side driver electrode is raised to VW+½ VM (220 V), whereas the potential of the non-selected data-side electrode is also raised to VW −½ VM (160 V). If the selected scan-side electrode is of an odd number, the potentials of all the MOS transistors PT2 through PTi inside the even-number scan-side P-ch MOS IC 250 are activated, and, as a result, the potentials of all the even-side scan electrodes are raised to VW (190 V). By sequentially driving the scan-side electrodes X1 to Xi through the first to third stages, the driving of the N-ch field is now completed, and the driving of the P-ch field is started in the following stage.

The first stage T1′ of the P-ch field: Preliminary charge period

During the preliminary charge period, the same operations as those performed during the first stage of the N-ch field are executed.

The second stage T2′ of the P-ch field: Discharge/pull-up charge period

Figure 11A:
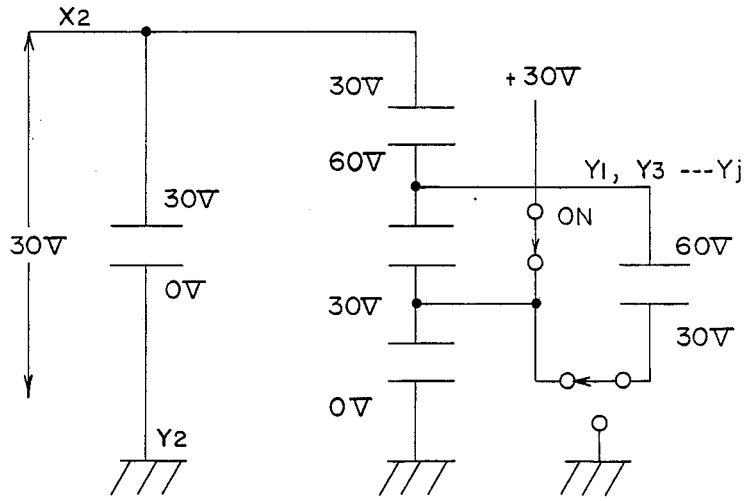
FIGS. 11 (*a*), (*b*), and (*c*) are, respectively, the status of the electrode potentials showing the operations of the drive circuit shown in FIG. 1.
Figure 11B:
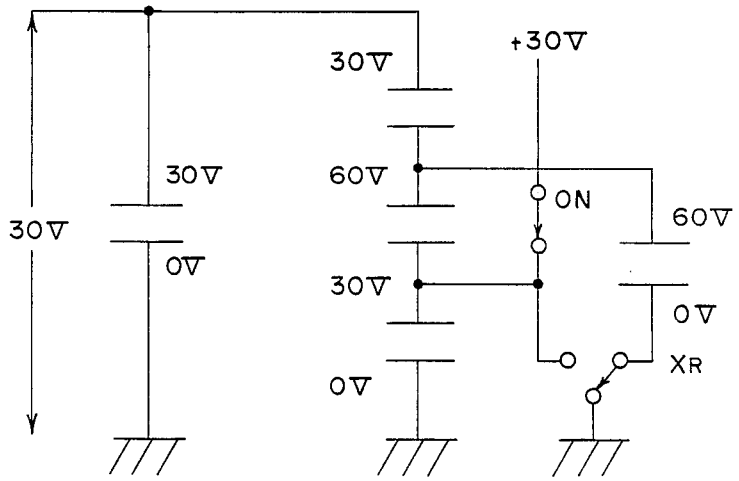
Figure 11C:
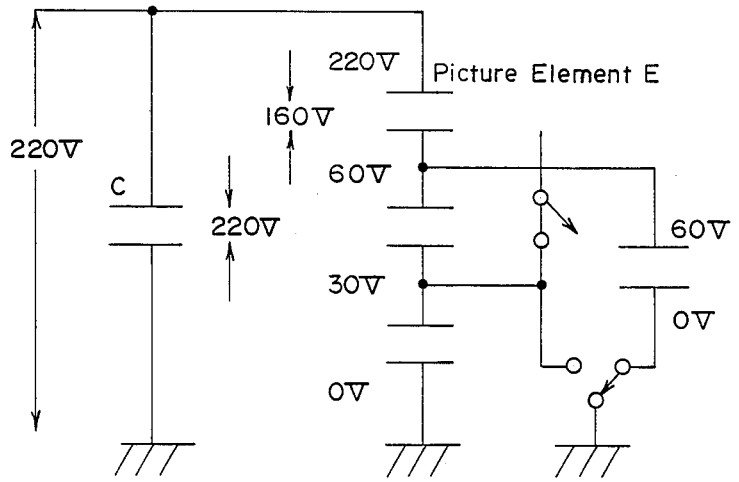

Next, all the MOS transistors NT1 through NTi inside the scan-side N-ch MOS ICs 220 and 230 are turned OFF, while only the MOS transistors connected to the selected data-side drive electrodes inside the data-side driver electrode inside the data-side N-ch MOS IC 260 are activated, MOS transistors connected to the other data-side drive electrodes are turned OFF. Simultaneously, all the MOS transistors PT1 through PTi inside the scan-side P-ch MOS ICs 240 and 250 are activated. Charge stored in the selected data-side electrode is discharged by the ground loop formed by the combination of MOS transistors inside the activated data-side N-ch MOS IC 260, all the MOS transistors PT1 through PTi inside the scan-side P-ch MOS ICs 240 and 250, and diode 301 inside the write-driving circuit 300. Next, the potentials of all the scan-side electrodes are raised to ½ VM (30 V) by activating all the MOS transistors inside the scan-side P-ch MOS ICs, and the pull-up charge drive circuit 290. During this period, all the MOS transistors inside the scan-side N-ch MOS ICs remain OFF. FIG. 11 (*a*) shows the status of the potentials while the above operations are underway. When the third stage T3′ is entered, several units of the N-ch MOS transistors of the scan-side corresponding to non-selected scanning electrodes are activated. Note that these may be selected from either the odd or even side. During this period, by activating either the whole or a major part of the scan-side P-ch MOS transistors not connected to the activated N-ch MOS transistors, the potentials of the non-selected data-side electrodes Y1, Y3, . . . Yj are held at 60 V. FIG. 11 (*b*) shows the status of this potential. In FIG. 11 (*b*), symbol XR indicates a plurality of scan-side electrodes connected to several units of the activated N-ch MOS transistors mentioned above.

The third stage T3′ of the P-ch field: Write-driving period

If the selected scan-side electrode is X2, only MOS transistor PT2 connected to X2 inside the scan-side P-ch MOS IC 250 is activated before supplying VW+½ VM (220 V) of voltage through the write driving circuit 300. At the same time, a write voltage, with a polarity opposite to that which was applied when performing the operations during the third stage of the N-ch field, is also supplied by activating several units of the scan-side N-ch MOS transistors selected during the second stage T2′ while the non-selected MOS transistors, the MOS transistors inside the data-side N-ch MOS transistors other than those selected several units of the scan-side N-ch MOS transistors, and all the MOS transistors inside the odd-side P-ch MOS IC 240 remain OFF. As a result, due to the characteristics of the coupled capacitance, the potential of the selected data-side electrode is lowered to (−VW+½ VM) (=−220 V), while the potential of the non-selected data-side electrode is also lowered to (−VW−½ VM) (=−160 V), respectively. The statuses of these potentials are shown in FIG. 11 (*c*). As is clear from FIG. 11 (*c*), 220 V of voltage is delivered to the selected picture element C, which then illuminates itself. Conversely, only 160 V of voltage below the threshold value is supplied to the non-selected picture element E on the selected scan-side electrode, and, as a result, no light is illuminated. If the selected scan-side electrode is of an odd number, write voltage is supplied by activating the MOS transistors connected to the selected scan-side electrodes inside the scan-side P-ch MOS IC 240 on the odd-line side, a plurality of MOS transistors in the scan-side N-ch MOS ICs 220 and 230, and the selected data-side N-ch MOS transistors altogether. The driving of the P-ch field is now completed. By sequentially driving the scan-side electrodes X1 to Xi through the first to third stages.

As is clear from the timing chart shown in FIG. 10, a picture element at a selected crossing point eventually receives AC pulses containing VW+½ VM (=220 V) of the write voltage which is quite enough for illumination with an inverse polarity in the N-ch and P-ch fields. Although a voltage VW−½ VM (=160 V) is supplied to those picture elements which are in the non-selected crossing points, since this voltage is still below the threshold level necessary to implement illumination, those picture elements cannot illuminate themselves. Despite the identical waveforms generated, by supplying the write pulses to the selected picture elements in accordance with the methods thus described, the preferred embodiment of the present invention effectively reduces the number of drive circuit component elements and securely prevents the drive circuit from malfunctions caused by noise interference.

Figure 12:
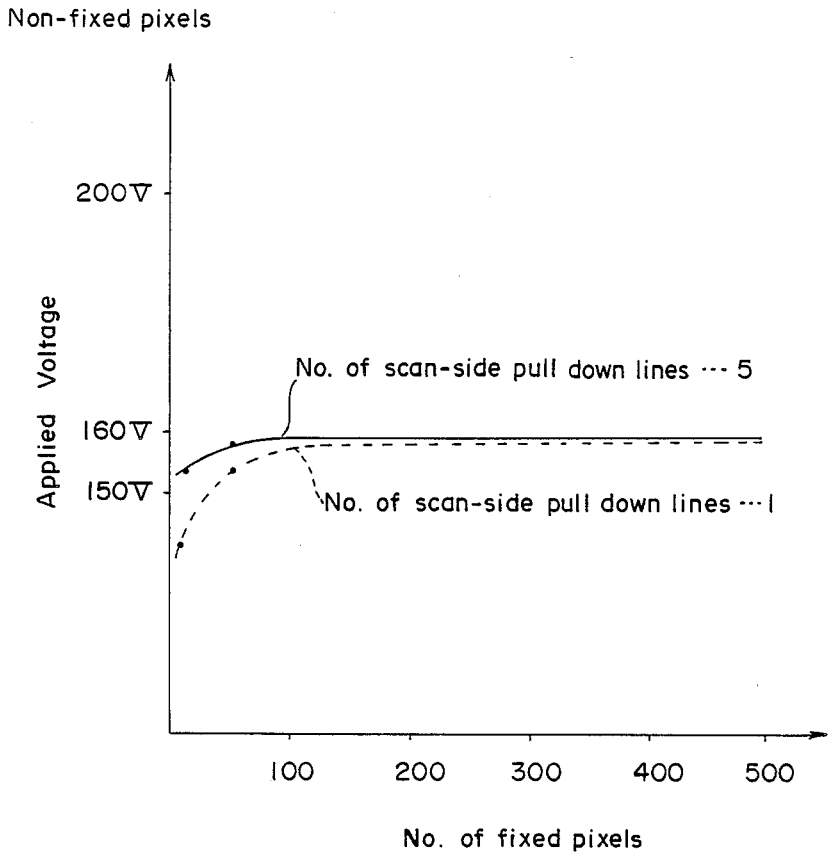
FIG. 12 is a chart denoting the relationship between the number of light-emitting picture elements and the voltages supplied to the non-illuminated picture elements when the parameter is composed of the scan-side pull-down lines while the write-driving operation is being performed in the P-ch field.

FIG. 12 shows a graphic chart denoting the relationship between the number of illuminating picture elements and the voltages supplied to non-illuminating picture elements when the parameter is composed of the number of scan-side pull-down lines in the P-ch field.

The preferred embodiment of the present invention provides an extremely reliable drive circuit capable which effectively reduces the number of power sources required for a plurality of output-insulated logic circuits and also of reducing the number of signal transmission photo-couplers to one-half those required by the former circuit configuration of the former invention entitled "THIN-FILM EL DISPLAY PANEL DRIVE CIRCUIT" under Japanese Patent Application No. 66166 and taken out in 1984, which presented the field-inverted driving system provided with both the N-ch and P-ch MOS drivers for driving the scan-side electrodes. The new drive circuit embodied by the present invention securely prevents itself from malfunction due to noise interference to the signal transmission system incorporated in it.

What is claimed is:

1. A thin-film electroluminescent display panel drive circuit having electroluminescent layers disposed between scan-side electrodes and data-side electrodes, said scan side and data-side electrodes being orthogonally aligned, said scan-side electrodes being alternatively divided into an odd group and an even group comprising:

a pull-up charge drive circuit;

a write drive circuit for supplying a write pulse;

a preliminary charge drive circuit;

a diode array, connected to said preliminary charge drive circuit;

a scan-side first type channel high-voltage resistant drive for each odd and even group of scan-side electrodes including a plurality of transistors having grounded source terminals and drain terminals connected to said scan-side electrodes;

a scan-side second type channel high-voltage resistant driver for each odd and even group of scan-side electrodes including a plurality of transistors having drain terminals connected to said drain terminals of said first type channel high voltage driver and having source terminals connected to said pull-up charge drive circuit and to said write drive circuit via a scan-side common bus line, said scan-side second type channel high voltage resistant driver providing a write pulse from said write drive circuit to selected pixels through said scanning electrodes of a first polarity in a first driving field and of a second polarity in a second driving field;

a data-side first type channel high-voltage resistant driver including a plurality of transistors having grounded source terminals and drain terminals connected to said data-side electrodes, and also having anode common terminals connected to the cathode terminals of the diode array which is connected to the preliminary charge drive circuit via a data-side common bus line;

means for activating repeatedly in said first driving field a selected transistor of said scan-side first type channel high voltage resistant driver and all the transistors of said scan-side second type channel high voltage resistant driver of the opposite group of said scan-side electrodes, and for activating repeatedly in said second driving field a selected transistor of the scan-side second type channel high voltage resistant driver of the same group as the selected scan-side electrode, several units of the same group as the selected scan side first type channel high-voltage resistant driver, and a selected MOS transistor of the data-side first drive channel high-voltage resistant driver so as to develop first and second write pulses to all said pixels in said first and second driving fields with a constant phase relationship therebetween to each said selected pixel.

2. A drive system for a thin-film electroluminescent (EL) matrix display panel comprising:

data side electrodes formed on one major surface of the thin-film electroluminescent (EL) matrix display panel generally extending in a first direction;

scanning side electrodes formed on the opposing major surface of said thin-film electroluminescent (EL) matrix display panel in a second direction substantially perpendicular to said first direction, said scanning side electrodes being alternately divided into odd number scanning electrodes and even number scanning electrodes;

a pull-up charge driving circuit;

a precharge driving circuit;

a write driving circuit for providing first and second write pulses;

an odd side first type channel high voltage MOS driver connected to said odd number scanning electrodes at one end thereof, the other end of said odd side first type channel high voltage MOS driver being grounded;

an odd side second type channel high voltage MOS driver connected to said odd number scanning electrodes at one end thereof, the other end of said odd side second type channel high voltage MOS driver being connected to said pull-up charge driving circuit and said write driving circuit;

an even side first type channel high voltage MOS driver connected to said even number scanning electrodes at one end thereof, the other end of said even side first type channel high voltage MOS driver being grounded;

an even side second type channel high voltage MOS driver connected to said even number scanning electrodes at one end thereof, the other end of said even side second type channel high voltage MOS driver being connected to said pull-up charge driving circuit and said write driving circuit; and a data side first type channel high voltage MOS driver connected to said data side electrodes at one end thereof, the other end of said data side first type channel high voltage MOS driver being connected to said precharge driving circuit;

first activating means for repeatedly activating in a first driving field a selected MOS transistor of one of said odd or even side first type channel high voltage MOS drivers corresponding to a selected scanning side electrode and all the MOS transistors of one of said odd or even side second type channel high voltage MOS drivers not corresponding to the same group as said selected scanning side electrode;

second activating means for repeatedly activating in a second driving field a selected MOS transistor of one of said odd or even second type channel high voltage MOS drivers corresponding to a selected scanning side electrode, a selected portion of the MOS transistors of said odd and even first type channel high voltage MOS drivers, and a selected MOS transistor of said data side first type channel high voltage MOS driver;

said odd side second type channel MOS driver providing said first write pulse to said odd number scanning electrodes when an even number scanning electrode is selected in said first driving field and providing said second write pulse to a selected odd number scanning electrode when in said second driving field;

said even-side second type channel MOS driver providing said first write pulse to said even number scanning electrodes when an odd number scanning electrode is selected in said first driving field and providing said second write pulse to a selected even number scanning electrode in said second driving field;

said first and second write pulses being applied to all said pixels in said first and second driving fields with a constant phase relation therebetween to each said pixel;

said first write pulse providing being of a polarity opposite to said second write pulse which is provided.

3. The drive system of claim 2 wherein said scanning side electrodes and said data side electrodes intersect to form a plurality of display panel pixels;

said drive system supplying said first and second write pulses with a phase difference therebetween which is substantially the same for all of said display panel pixels.

4. A method of driving an electroluminescent matrix display panel having a plurality of pixels defined by data electrodes and scanning electrodes, said scanning electrodes being arranged in alternating even and odd groups comprising:

(a) precharging all said pixels with a first precharge voltage;

(b) discharging all said pixels associated with non-selected data electrodes while applying a pull-up voltage to leave only those pixels associated with a selected data electrode charged;

(c) applying a first writing pulse of a first polarity to each of selected one of said pixels associated with a selected scanning electrode and said selected data electrodes by applying a voltage directly to the other of said even and odd groups to which said selected scanning electrode is associated, said selected scanning electrode being held to a ground level, said applied voltage pulling up said other group of scanning electrodes to form said first writing pulse when superimposed on said first precharge voltage to initiate electroluminescence of said pixels associated with said selected scanning and data electrodes;

said steps of (a) precharging, (b) discharging, and (c) applying being performed for each scanning electrode;

(d) precharging all said pixels with a precharge voltage;

(e) discharging all said pixels associated with a selected data electrode while applying a pull-up voltage to leave only these pixels associated with non-selected data electrodes charged;

(f) selecting a portion of non-selected scanning electrodes;

(g) applying a second writing pulse of said second polarity to each of said pixels associated with a selected scanning electrode and said selected data electrodes by applying a voltage directly to said selected scanning electrode while holding the selected portion of said non-selected scanning electrodes to a ground level, said applied voltage pulling down said data electrodes and developing a net voltage across said pixels associated with said selected scanning and data electrodes to cause electroluminescence;

said steps of (d) precharging, (e) discharging, and (g) applying being performed for each scanning electrode;

said step (c) of applying said first write pulse and said step (g) of applying a second write pulse apply these pulses to all said pixels with a substantially constant phase difference between respective said first and second write pulses for each said pixel.

* * * * *